United States Patent [19]

Hess

[11] 4,318,692

[45] Mar. 9, 1982

[54] HELICAL DUCT GAS/MEAL SEPARATOR

[75] Inventor: Paul D. Hess, Brookfield, Wis.

[73] Assignee: Allis-Chalmers Corporation, Milwaukee, Wis.

[21] Appl. No.: 222,034

[22] Filed: Jan. 2, 1981

[51] Int. Cl.[3] ..... F27B 15/00; F27B 7/02

[52] U.S. Cl. ..... 432/58; 432/106

[58] Field of Search ..... 432/58, 106

[56] References Cited

U.S. PATENT DOCUMENTS 3,836,323 9/1974 Engel ..... 432/106

4,119,396 10/1978 Abelitis et al. ..... 432/106

FOREIGN PATENT DOCUMENTS 1586476 2/1970 France ..... 432/58

*Primary Examiner*—John J. Camby

*Attorney, Agent, or Firm*—Lee H. Kaiser

[57] ABSTRACT

A helical duct separator particularly suited for use in the suspension preheater of a cement calcining plant to separate raw cement meal from kiln-off gases in which the meal is suspended comprises a hollow elongated continuous duct having its longitudinal axis disposed along a downwardly inclined helical path, an inlet opening in a vertical plane for receiving a horizontal stream of gas with entrained meal, a downwardly inclined upper wall and a concave outer sidewall in the path of the gas stream to deflect the gas stream into a downwardly inclined helical path, a horizontal bottom wall adjacent the outlet end of the duct, a meal exit opening in the bottom wall and a gas exhaust opening in a horizontal plane in the upper wall adjacent the outlet end of the duct. The gas stream so directed in a downwardly inclined helical path impinges on the horizontal bottom wall and is deflected upward and drawn upward by suction from an induced draft fan toward the gas exhaust opening while the heavier meal is precipitated from the gas stream and urged by centrifugal and inertial forces to flow along the bottom wall and through the meal exit opening. The helical duct separator is substantially shorter in height, and has a substantially lower pressure drop, than a cyclone separator, thereby permitting reduction in the height of, and the energy required to operate, a suspension preheater in comparison to one of the cyclone separator type.

13 Claims, 8 Drawing Figures

HELICAL DUCT GAS/MEAL SEPARATOR

BACKGROUND OF THE INVENTION

Plants for heat treating granular raw material such as cement raw meal often include one or more vertical multi-stage suspension preheater strings each of which includes a plurality of serially connected cyclone separators that receive cement raw material at the top and hot exhaust gases from the rotary kiln at the bottom with countercurrent flow of the hot gases and the cement raw meal through the preheater to thereby preheat the raw cement feed for the rotary kiln. A typical calcining cement suspension preheater string may include four serially connected cyclone separators interconnected by heat exchanger conduits and meal pipes to achieve four stages of heat exchange. Each cyclone separator has an inlet for hot gas and suspended raw meal, an outlet at its upper end for separated hot gases conected to a stage above, and an outlet at its lower end for separated raw cement meal connected to a stage below. The cyclone separators in the suspension preheater string are spaced apart vertically, and the raw cement meal flows by gravity through meal pipes interconnecting the cyclone separators while kiln-off gas is moved upwardly through the separators and heat exchanger conduits by suction from an induced draft fan.

Cement plants of such multi-stage preheater strings are of extreme vertical height, for example, 190 feet height for a four stage cyclone-type suspension preheater, and the vertical dimension of each cyclone separator contributes significantly to the undesirable height of a conventional cyclone-type suspension preheater tower.

A conventional cyclone separator has a relatively high gas pressure drop and relatively high friction loss which result in high energy losses in the calcining cement suspension preheater and necessitate use of high horsepower induced draft fans. Power consumption in a cyclone type preheater results principally from moving the gas against the pressure differential of the cyclone separators. A major portion of the gas pressure drop in a cyclone separator results from: (a) the energy required to draw the relatively low whirl velocity gas at the cyclone body diameter into the higher whirl velocity of the gas exit pipe diameter, and (b) the unrecovered energy of the higher whirl velocity of the exit gas stream.

OBJECTS OF THE INVENTION

It is an object of the invention to provide an improved separator for separating hot gas from raw cement meal in the suspension preheater of a cement calcining plant which is substantially lower in height than a conventional cyclone separator.

It is a further object of the invention to provide an improved separator for separating hot gases from raw cement meal in a multi-stage suspension preheater of a cement calcining plant which results in a more compact preheater than one using cyclone separators and permits reduction of up to forty percent in the height of the suspension preheater tower.

A still further object of the invention is to provide an improved separator for separating hot gases from raw cement meal in a suspension preheater of a cement calcining plant which has substantially lower gas pressure drop than a conventional cyclone separator. Still another object is to provide such an improved separator for separating hot gas from raw cement meal in a suspension preheater of a cement calcining plant which results in substantial reduction in the total system energy required to operate the preheater and permits use of fans which develop only approximately one-half the power of fans typically used with cyclone-type preheaters. Another object is to provide an improved heat exchanger and meal/gas separator stage for a cement calcining plant suspension preheater which results in minimum preheater height and minimum preheater energy losses in comparison to prior art apparatus.

SUMMARY OF THE INVENTION

A helical duct inertial separator for separating raw cement meal descending by gravity in a suspension preheater string of a cement calcining plant from hot rising kiln-off gases in which the meal is suspended comprises a hollow elongated continuous duct having its longitudinal axis disposed generally along a downwardly inclined helical path with its outlet end disposed at a lower level than its inlet end and having a vertically facing inlet for receiving a horizontal stream of kiln-off gas with cement meal suspended therein and means including a downwardly inclined upper wall portion and a concave outer sidewall portion for deflecting the gas stream and suspended particles into a downwardly inclined helical path within the duct. The elongated duct also has a horizontal bottom wall portion in the path of the helically downward directed gas stream, a meal exit opening in the bottom wall portion adjacent the outlet end of the duct, and a gas exhaust opening disposed in a horizontal plane in the top wall adjacent the outlet end of the duct. The horizontal bottom wall portion deflects the gas stream upward toward the gas exhaust opening, and the meal is precipitated from the gas stream and flows under centrifugal and inertial forces along the horizontal bottom wall portion and through the meal exit into a hopper. Preferably the longitudinal axis of the elongated duct extends generally along an arc, and the gas inlet opening and the gas exhaust opening are approximately at the same radial distance from the center of the arc so that the gas pressure drop across the separator is minimized.

A single stage heat exchanger and gas/meal separator embodying the invention includes such helical duct inertial separator; an upwardly inclined heat exchanger elbow conduit of generally inverted-L shape registering at its upper end with the vertically facing gas inlet opening of the helical duct separator and at its lower end with the upwardly facing gas exhaust opening of the stage below; a meal pipe communicating at its upper end with the meal exit opening of the stage above and at its lower end with the interior of the heat exchanger elbow conduit; and a meal splash plate disposed within the heat exchanger elbow conduit opposite the lower end of the meal pipe to distribute the separated meal from the stage above into the hot separated gases from the stage below rising within the heat exchanger elbow conduit.

BRIEF DESCRIPTION OF THE DRAWINGS

The invention will be described in connection with the attached drawing wherein.

DETAILED DESCRIPTION

Figure 1:
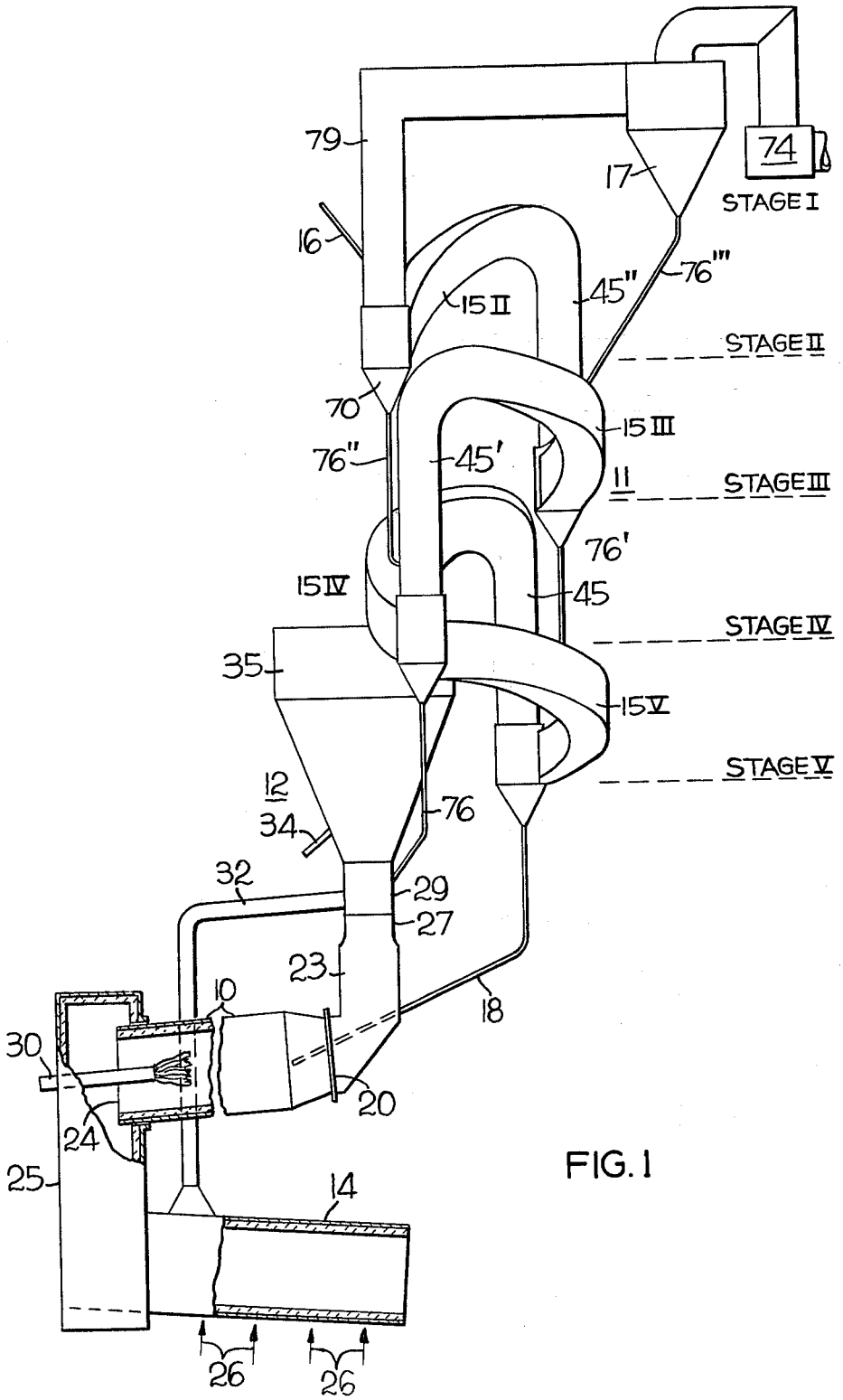
FIG. 1 is a schematic front view of a cement calcining plant multi-stage suspension preheater string having helical duct inertial separators embodying the invention for segregating hot kiln-off gases from raw cement meal.

FIG. 1 schematically illustrates a cement calcining plant disclosed in my copending application Ser. No. 222,035 entitled Suspension Preheater for Cement Calcining Plant filed Jan. 2, 1981, and including a rotary cement clinkering furnace, or kiln 10, a single multi-stage cement suspension preheater string 11 including a calcining combustor, or calcining furnace 12 for substantially completely calcining the preheated raw cement meal before it is fed to kiln 10, and a clinker cooler 14 coupled after the kiln 10 for cooling the product treated in the kiln.

Suspension preheater 11 is shown as having connected in series an upper stage I having a cyclone separator 17, three serially flow-connected meal/gas separator stages II, III and IV each having an inertial helical duct separator 15 embodying the present invention designated 15II, 15III and 15IV respectively, and a calcination stage V including calcining furnaces 12 and a helical duct inertial separator embodying the invention designated 15V. Suspension preheater 11 has an inlet pipe 16 for cement raw meal at the top thereof and an outlet meal pipe 18 connecting calcination stage V to the meal inlet end 20 of the rotary kiln 10.

The cement meal inlet end 20 of kiln 10 communicates with guide means such as a hood 23 having an opening in a vertical plane surrounding kiln end 20. The clinker discharge end 24 of kiln 10 may communicate with a casing 25 which at its lower end joins cooler 14 which may be of the grate type. Cooler 14 receives the hot clinker discharged from kiln 10 through casing 25, and the hot clinker is advanced through cooler 14 while being swept by atmospheric cooling air supplied to cooler 14 indicated by arrows 26 with the result that the hot clinker is cooled and the cooling air is heated. Hood 23 has a restricted furnace gas conduit 27 at its upper end which communicates with a mixing pipe 29 at the lower end of calcining combustor 12. Part of the hot air from cooler 14 leaving casing 25 is passed through kiln 10 where the oxygen therein nourishes combustion of fuel blown into kiln 10 through a burner pipe 30 provided at the clinker discharge end 24 of kiln 10. The hot exhaust gases pass through kiln 10 countercurrent to the preheated, substantially completely calcined cement meal which is fed from outlet meal pipe 18 of calcination stage V into meal inlet end 20 of kiln 10. The cement meal moves down through kiln 10 where it is chemically and physically changed under the influence of the heat in kiln 10. the hot exhaust gases leave kiln 10 and enter hood 23 and then exit from hood 23 through furnace gas exhaust conduit 27 into mixing pipe 29. Hot air from clinker cooler 14 flows through an air duct 32 into mixing chamber 29. Preheated cement meal from inertial separator 15IV of stage IV is introduced into mixing pipe 29 through meal pipe 76, i.e., into the preheated cement meal inlet to calcining combustor 12, and is entrained in the hot kiln-off gases rising through furnace gas exhaust conduit 27. A splash plate (not shown) is disposed within mixing pipe 29 opposite the lower end of meal pipe 76 to distribute the meal into the hot kiln-off gases rising through conduit 27 which mix with the air from cooler 14 introduced into mixing pipe 29 through duct 32. Fuel is also introduced through inlet pipes 34 into combustor 12 where it burns to heat and calcine the raw cement material so suspended in the hot gas before the meal is introduced into kiln 10. Combustion within calcining furnace 12 is nourished by oxygen contained in the heated air from cooler 14 introduced through duct 32.

Figure 2:
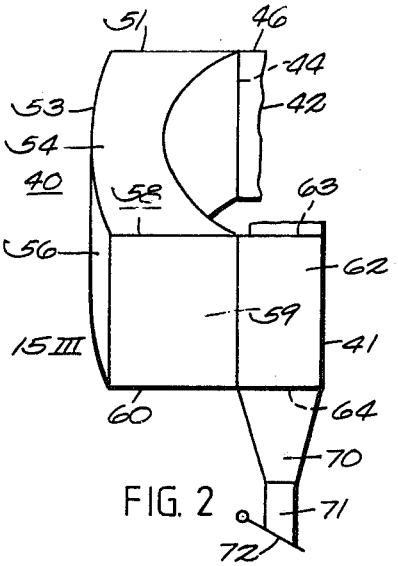
FIGS. 2, 3 and 4 are front, top and side views respectively of the separators shown in FIG. 1 which embody my invention.
Figure 3:
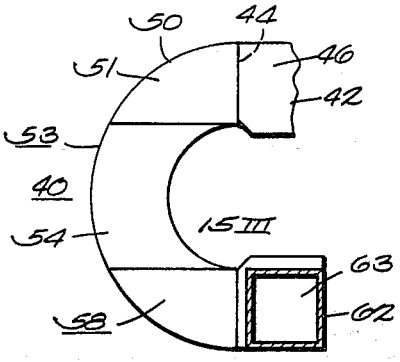
Figure 4:
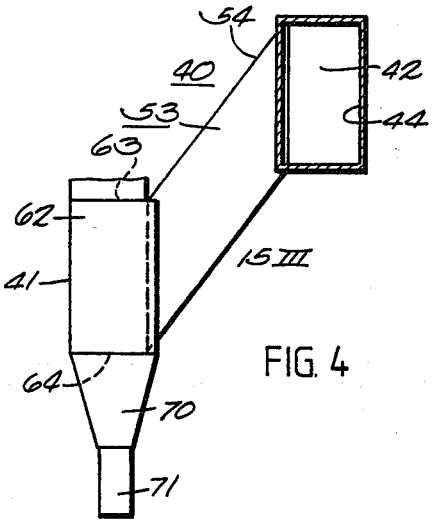

Gas meal helical duct inertial separator 15III of stage III is shown in detail in FIGS. 2, 3 and 4 and includes a hollow elongated continuous duct 40 of rectangular transverse cross-section having its longitudinal axis disposed generally along a generally spiral path, i.e., more specifically along a portion of a downwardly inclined turn of a helix whose axis is vertical. Elongated continuous duct 40 is preferably approximately U-shaped in longitudinal cross-section with its outlet end 41 disposed at a vertically lower elevation than its inlet end 42. Duct 40 has a vertically facing inlet opening 44 adjacent inlet end 42 for receiving a generally horizontal current, or stream of hot gas with raw cement meal entrained, or suspended therein. The horizontal gas current flowing into inlet opening 44 comprises hot kiln-off gases from the stage below flowing upward through a heat exchange elbow conduit 45' of generally inverted-L configuration (See FIG. 5) and rectangular transverse cross-section having the cross bar portion 46 thereof registering with inlet opening 44 and the upwardly inclined leg portion 48 registering with the gas exhaust opening of the helical duct separator 15IV of the stage below.

Inlet opening 44 is in a vertical plane and is partially defined by horizontal top and bottom walls and a curvate vertical sidewall 50 of a first transition portion 51 of helical duct 40. Curvate vertical sidewall 50 is in the path of the horizontal gas stream and directs the gas stream and suspended meal horizontally and at an acute angle from the inlet direction into a downwardly inclined generally arcuate-in-longitudinal-cross-section portion 53 of duct 40 which registers with first transition portion 51. Arcuate portion 53 is of rectangular transverse cross-section and has a downwardly inclined upper wall 54 and a vertical, concave, outer sidewall 56 both of which are in the path of the horizontal gas current from first transition portion 51 and together with sidewall 50 comprise means to deflect the gas stream and suspended meal into a downwardly inclined helical path within duct 40 so that they are acted upon by radially outward directed centrifugal force and tangentialy directed inertial forces.

At its downstream end arcuate portion 53 of duct 40 registers with a second transition portion 58 having a horizontal top wall, a horizontal bottom wall 60 and a curvate vertical sidewall 59. Bottom wall 60 and curvate sidewall 59 of second transition portion 58 are in the path of the gas stream and suspended meal which are being acted upon by centrifugal and inertial forces. Curvate sidewall 59 changes the direction of the gas stream and suspended meal particles into a path approximately the reverse of the direction of the horizontal current received by inlet opening 44, and horizontal bottom wall 60 deflects the gas stream upward and redirects the downwardly urged heavier meal particles horizontally so that they precipitate from the gas stream and flow under centrifugal and inertial forces along bottom wall 60.

Second transition portion 58 communicates with a meal collection box 62 which in its upper wall has a gas exhaust opening 63 in a horizontal plane and in its lower wall has a meal exit opening 64 in a horizontal plane. Gas exhaust opening 63 registers with the upwardly extending leg portion 48 of the generally inverted-L shaped heat exchanger elbow conduit 45'' of stage II above. Meal exit opening 64 communicates with the upper end of a meal hopper 70 which may be of generally inverted pyramidal configuration truncated at its apex. At its lower end hopper 70 terminates in a vertical meal outlet pipe 71 that is closed by a meal valve 72 to prevent air or gas from entering meal outlet pipe 71 under vacuum operating conditions. As described hereinafter, meal outlet pipe 71 communicates with a meal pipe 76' (see FIG. 1) which feeds separated meal to the heat exchange elbow conduit 45 of stage IV below. The gas stream is deflected upwardly by horizontal bottom wall 60 of second transition portion 58 and drawn by suction from conduit 45'' toward gas exhaust opening 63 while the heavier meal particles precipitate from the gas stream and flow under centrifugal and inertial forces along horizontal bottom wall 60 and through meal exit opening 64 into hopper 70.

Helical duct 40 is thus defined by first transition portion 51, arcuate portion 53, second transition portion 58 and meal collection box 62 and preferably is of arcuate longitudinal cross-section and preferably extends through approximately 180 degrees of arc, and inlet opening 44 and gas exhaust opening 63 are at approximately the same radial distance from the center of such arc. This configuration results in substantial reduction in pressure drop across my inertial helical duct separator 15 in comparison to a conventional cyclone separator wherein a major portion of the gas pressure loss results from the energy required to draw the relatively low whirl velocity gas at the cyclone body outer diameter into the higher whirl velocity of the axial exit gas stream. It will be appreciated that such losses are substantially eliminated in my helical duct inertial separator 15.

Figure 6:
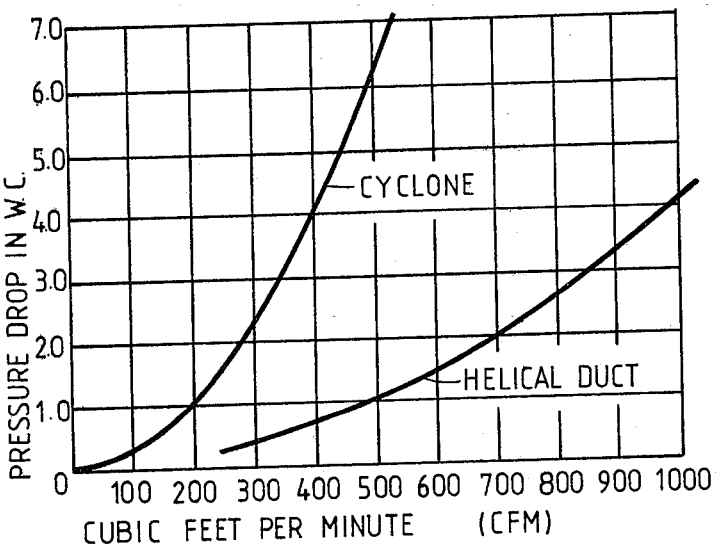
FIG. 6 is a graph plotting pressure drop versus volume of raw cement meal flow per unit time in a conventional cyclone separator and in a helical duct separator embodying the invention.

FIG. 6 plots the pressure drop (in inches of water) versus volume of ambient air flow per unit of time (in cubic feet per minute) through: (a) a conventional cyclone separator; and (b) a helical duct separator 15 embodying my invention, and it will be noted that the pressure drop through my helical duct separator 15 is only a minor fraction of the pressure loss in a cyclone separator for a given volume of gas flow per unit time. For example, FIG. 6 shows that the pressure drop in drawing 500 cubic feet per minute of ambient air through my helical duct separator 15 is approximately 1.05 inches of water, whereas the pressure drop in moving the same volume through a conventional cyclone separator is approximately 6.1 inches of water. It will be appreciated that such difference in pressure loss greatly reduces the static pressure and power that a fan, such as induced draft fan 74 represented in FIG. 1, must develop to move the kiln-off gases through the multiple stages of the preheater string in comparison to a preheater of the cyclone separator type since power consumption in a preheater results principally from moving the gas against the differential pressure of the separator.

Figure 5:
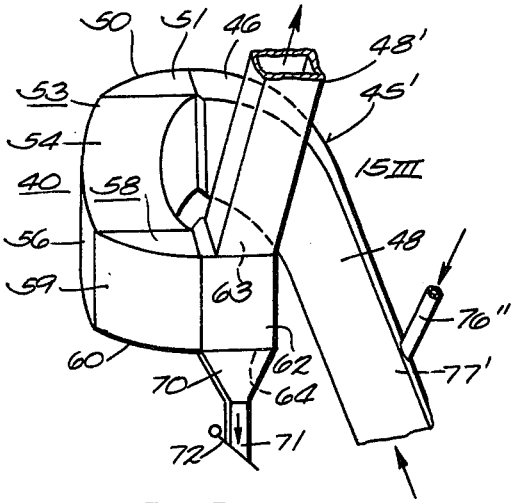
FIG. 5 is a front view of a single stage heat exchanger and meal/gas separator embodying the invention.

FIG. 5 illustrates a single stage heat exchanger and helical duct meal/gas separator embodying the invention, for example, single stage III which includes helical duct separator 15III, heat exchanger elbow conduit 45' which registers at its upper end with gas inlet opening 44 of separator 15III and at its lower end with gas exhaust opening 63 of stage IV; separated meal pipe 76'' whose upper end communicates with meal outlet pipe 71 from hopper 70 of stage II and at its lower end communicates with the interior of the leg portion 48 of heat exchanger elbow conduit 45'; and a splash plate 77' positioned within conduit 45' opposite the lower open end of meal pipe 76'' which distributes the separated meal from pipe 76'' into the hot separated gases from stage IV rising through elbow conduit 45'. The cement meal separated in stage II and descending through pipe 76'' is moved upward through substantially the entire length of elbow conduit 45' by rising hot gases from gas exhaust opening 63 of stage IV to achieve maximum heat transfer and further preheat the meal before it is separated from the gases in separator 15III and then fed through meal pipe 76' into elbow conduit 45 of stage IV.

FIG. 1 schematically represents that suspension preheater string 11 includes upper stage I having cyclone separator 17 which removes the extra fine particles in the raw cement meal fed into meal inlet pipe 16; an induced draft fan 74 connected to the gas exhaust outlet of cyclone separator 17 for drawing the kiln-off gases with cement meal entrained therein through the five stages of preheater 11; a heat exchanger elbow conduit 79 which registers at its upper end with the gas inlet to cyclone separator 17 and at its lower end with gas exhaust opening 63 of stage II; meal inlet pipe 16 which registers with the interior of heat exchanger elbow conduit 79 and through which raw cement meal is fed to preheater 11 and carried upward through conduit 79 with the rising hot separated gases from helical duct separator 15II to preheat the cement meal; a meal pipe 76''' which registers at its upper end with the separated meal outlet from cyclone separator 17 and at its lower end with the interior of heat exchanger elbow conduit 45'' of stage II so that the meal separated in cyclone separator 17 is further preheated by the gases separated in stage III rising within heat exchanger conduit 45''; meal pipe 76'' which at its upper end registers with separated meal hopper 70 of helical duct separator 15II of stage II at its lower end with the interior of heat exchanger elbow conduit 45' so that the meal separated in stage II is further preheated by the gases separated in stage IV rising through conduit 45'; meal pipe 76' which at its upper end communicates with separated meal hopper 70 of helical duct separator 15III and at its lower end communicates with heat exchanger elbow conduit 45 to further preheat the separated meal from stage III by the gases separated from helical duct separator 15V of stage V rising within conduit 45; meal pipe 76 which at its upper end communicates with meal hopper 70 of helical duct separator 15V of fourth stage IV and at its lower end with the preheated meal inlet into mixing pipe 29 of calcining combustor 12; preheater stage V having a helical duct separator 15V whose gas inlet opening 44 registers with a combustion gas and calcined meal outlet (not shown) from the upper portion of calcining combustor 12 so that stage V receives substantially completely calcined cement meal as an input and whose separated meal hopper 70 is connected by meal pipe conduit 18 to the meal inlet end 20 of kiln 10.

Figure 8:
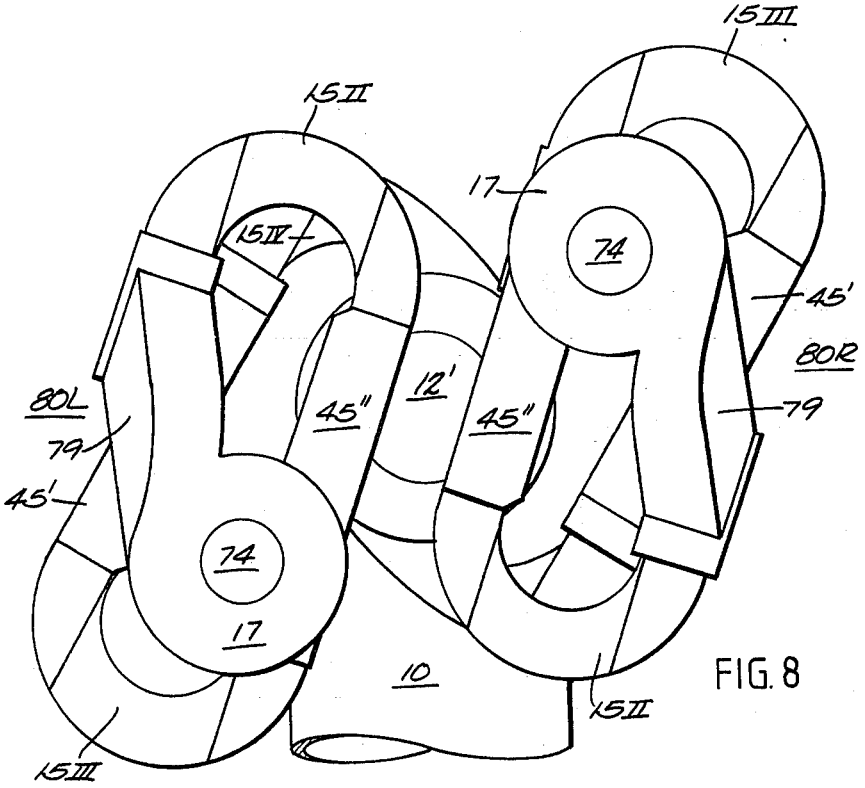
FIGS. 7 and 8 are front and top views respectively of a cement plant dual multi-stage suspension preheater analogous to the FIG. 1 apparatus but having only four stages.
Figure 7:
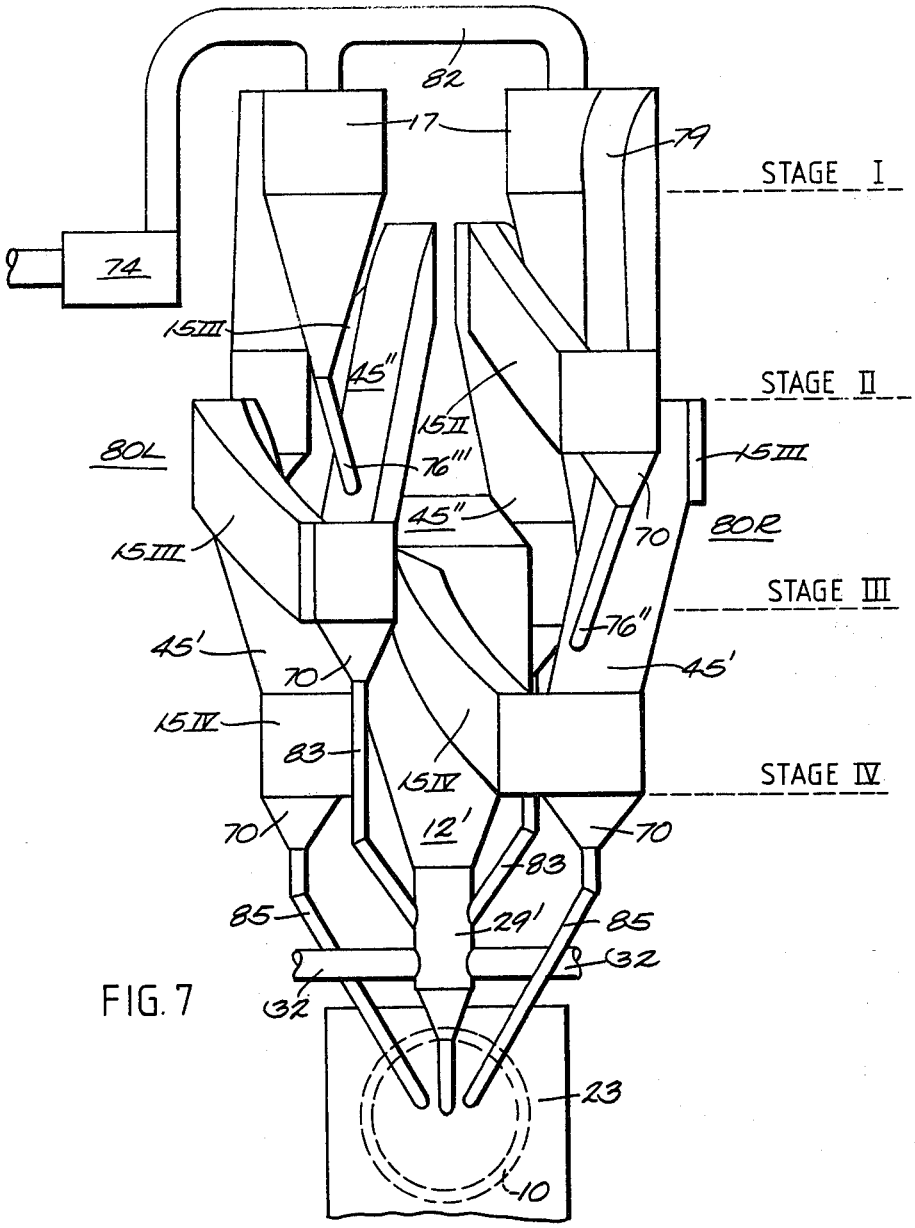

FIGS. 7 and 8 are front and top views respectively of a cement calcining plant dual preheater embodying helical duct inertial separators 15 of the invention and having two suspension preheater strings 80L and 80R both of which are analogous to preheater string 11 of the FIG. 1 apparatus with the exception that each comprises one cyclone type stage and only three helical duct separator stages. In effect, each preheater string 80L and 80R eliminates stage IV of the FIG. 1 apparatus. Both preheater strings 80L and 80R have an upper stage I provided with cyclone separator 17 whose gas inlet receives hot gases from an elbow conduit 79 which at its lower end communicates with the gas exhaust opening of helical duct inertial separator 15II of stage II. A conduit 82 communicating with the exhaust gas openings of cyclone separators 17 of both preheater strings is connected to a single induced draft fan 74 which moves the kiln-off gases through the meal/gas separators and heat exchanger conduits of both strings by suction. The meal outlet from cyclone separator 17 of stage I registers with a meal pipe 76''' which at its lower end communicates with the interior of an elbow conduit 45''. At its upper end elbow conduit 45'' registers with the gas inlet opening of helical duct separator 15II, and at its lower end conduit 45'' registers with the gas exhaust opening of helical duct separator 15III of stage III. Meal hopper 70 of stage II registers with meal pipe 76'' that communicates with the interior of elbow conduit 45' which at its upper end registers with the gas inlet opening of helical duct separator 15III of stage III and at its lower end communicates with the gas exhaust opening of helical duct separator 15IV of stage IV. Meal outlet pipe 83 from hopper 70 of separator 15III of strings 80L and 80R differs from the FIG. 1 apparatus in that at its lower end it communicates with the preheated meal inlet to mixing pipe 29' of a single calcining combustor 12' for both preheater strings 80L and 80R.

The fourth stage also differs from the FIG. 1 apparatus in that the gas inlet opening of helical duct separator 15IV of both strings 80L and 80R communicates with the combustion gas and calcined meal outlet of calcining combustor 12' adjacent the top thereof and also in that the meal hopper 70 of helical duct separator 15IV communicates with the upper end of a meal pipe 85 which at its lower end communicates with the meal inlet end of kiln 10. Two air inlet ducts 32 from the cooler communicate with mixing pipe 29' of calcining combustor 12'.

The height of each helical duct separator 15 embodying my invention is approximately 49 percent of the height of a typical cyclone separator. Inasmuch as preheater 11 of the FIG. 1 embodiment includes one cyclone separator stage I, the overall stacking height of the five stages of preheater 11 will be approximately sixty percent of the height of the typical cyclone separator preheater tower. The height of a typical four stage dual preheater of the cyclone separator type with a single combustion chamber rated at 3000 standard tons per day capacity is approximately 190 feet from the top to the longitudinal axis of the kiln, whereas the height of the four dual preheater illustrated in FIGS. 7 and 8 using helical duct separators embodying my invention in three stages thereof is only approximately 110 feet. Further, the pressure requirement of the induced draft fan for the dual preheater embodying my helical duct inertial separators illustrated in FIGS. 7 and 8 is less than one-half of a conventional four stage preheater with cyclone separators.

Tests establish that collection efficiency of helical duct separators 15 embodying the invention for finely ground meal is in the range from 84 to 88 percent and is only slightly less than that of a standard cyclone separator.

The embodiments of the invention in which an exclusive property or privilege is claimed are defined as follows:

1. A helical duct separator for segregating granular material from a gas in which said material is entrained comprising a hollow continuous elongated duct having its longitudinal axis disposed generally along a downwardly inclined helical path with its outlet end disposed at a vertically lower level than its inlet end and having a vertically facing inlet opening adjacent said inlet end for receiving a generally horizontal stream of said gas with said granular material entrained therein, said duct also having means including a downwardly inclined upper wall portion and a concave outer sidewall portion for deflecting said gas stream and entrained granular material into a downwardly inclined helical path within said duct, said duct also having a bottom wall portion in the path of said helically downward directed gas stream, a granular material exit opening in said bottom wall portion adjacent said outlet end, and a gas exhaust opening adjacent said outlet end at a level vertically above said meal exit opening, said bottom wall portion deflecting said gas stream upward toward said gas exhaust opening and said granular material being precipitated from said gas stream and flowing under centrifugal and inertial forces along said bottom wall portion and through said material exit opening.

2. A separator in accordance with claim 1 wherein said gas exhaust opening is in a horizontal plane and in the upper wall of said duct.

3. A separator in accordance with claim 2 wherein said concave vertical outer sidewall portion of said elongated duct extends generally along an arc, and said inlet opening and said gas exhaust opening are approximately at the same radial distance from the center of said arc, whereby the gas pressure drop across said separator is minimized.

4. A separator in accordance with claim 1, 2 or 3 wherein said elongated duct is of generally rectangular transverse cross-section and said bottom wall portion is generally horizontal.

5. A separator in accordance with claim 1, 2 or 3 wherein said elongated duct is of approximately U-shaped longitudinal cross-section.

6. A separator in accordance with claim 1, 2 or 3 and including a hollow meal hopper having an open upper end communicating with said meal exit opening.

7. A single stage heat exchanger and separator for the suspension preheater of a cement calcining plant adapted to transfer heat from a rising hot gas to raw cement meal and subsequently separate said meal from said gas including a helical duct inertial separator comprising a hollow elongated continuous duct having its longitudinal axis disposed along a downwardly inclined general helical path with its outlet end disposed at a vertically lower elevation than its inlet end and also having an inlet opening in a vertical plane adjacent its inlet end; an upwardly directed heat exchange elbow conduit registering at its upper end with said inlet opening for conveying said rising hot gas and being contoured to direct said gas in a horizontal stream through said inlet opening, a downwardly inclined meal pipe communicating with said heat exchange conduit below said inlet opening for introducing raw cement meal from the stage above into and entraining it within said gas rising within said heat exchange conduit, a meal splash plate disposed within said heat exchange conduit opposite the lower end of said meal pipe, said elongated duct having means including a downwardly inclined upper wall portion and a concave outer sidewall portion downstream from said inlet opening for deflecting said gas stream with said meal entrained therein into a downwardly inclined helical path within said duct, said elongated duct also having a bottom wall in the path of said helically downward directed gas stream, a meal exit opening in said bottom wall adjacent said outlet end, and a gas exhaust opening in its upper wall adjacent said outlet end, said bottom wall deflecting said gas stream upwardly toward said gas exhaust opening and said meal precipitating from said gas stream and flowing under centrifugal and inertial forces along said bottom wall and through said meal exit opening.

8. A single stage heat exchanger and separator in accordance with claim 7 wherein said outer sidewall portion extends generally along an arc, and said inlet opening and said gas exhaust opening are at approximately the same radial distance from the center of said arc, whereby the gas pressure drop across said separator duct is minimized.

9. A single stage heat exchanger and separator in accordance with claim 7 or 8 wherein said heat exchanger elbow conduit is of generally inverted-L shape with the crossbar portion thereof registering with said inlet opening in said elongated duct and directing said gas in said horizontal stream through said inlet opening.

10. A single stage heat exchanger and separator in accordance with claim 7 or 8 wherein said elongated duct is approximately U-shaped in longitudinal cross-section and of generally rectangular transverse cross-section.

11. A single stage heat exchanger and separator in accordance with claim 7 and including a meal hopper having an upwardly facing inlet opening registering with said meal exit opening.

12. A single stage heat exchanger and separator in accordance with claim 7 or 8 wherein said bottom wall of said duct is generally horizontal.

13. A separator for separating granular material from a gas in which it is entrained comprising a hollow continuous elongated duct of generally rectangular transverse cross-section and generally U-shaped longitudinal cross-section having its outlet end disposed at a lower elevation than its inlet end and being provided with a vertically facing inlet opening adjacent said inlet end for receiving a horizontal stream of said gas with said granular material entrained therein, means including a downwardly inclined upper wall and a generally arcuate concave vertical outer sidewall downstream from said inlet opening for deflecting said gas stream into a downwardly inclined generally helical path within said duct, the bottom wall of said duct adjacent said outlet end being generally horizontal, said duct having a downwardly facing granular material exit opening in said bottom wall and a gas exhaust opening in a horizontal plane in the top wall of said duct adjacent said outlet end, said gas stream impinging on said generally horizontal bottom wall so that the gas stream is deflected upward toward said gas exhaust opening and said granular material is precipitated from the gas stream and flows under centrifugal and inertial forces along said bottom wall and through said meal exit opening, said inlet opening and said gas exhaust opening being at approximately the same radial distance from the center of the arc along which said concave outer sidewall extends, whereby the gas pressure drop across said separator is minimized.

* * * * *